US008766971B2

(12) United States Patent
Park et al.

(10) Patent No.: US 8,766,971 B2
(45) Date of Patent: Jul. 1, 2014

(54) DRIVER IC AND ORGANIC LIGHT EMITTING DISPLAY DEVICE USING THE SAME

(75) Inventors: Sung-Cheon Park, Suwon-si (KR); Wook Lee, Suwon-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 1021 days.

(21) Appl. No.: 12/508,403

(22) Filed: Jul. 23, 2009

(65) Prior Publication Data

US 2010/0033514 A1 Feb. 11, 2010

(30) Foreign Application Priority Data

Aug. 6, 2008 (KR) ..... 10-2008-0076941

(51) Int. Cl.
*G09G 5/00* (2006.01)

(52) U.S. Cl.
USPC ..... 345/213; 345/208; 345/690; 345/77; 345/82; 315/169.3

(58) Field of Classification Search
USPC ..... 345/690, 76–84, 204, 208, 211–213; 315/169.3
See application file for complete search history.

(56) References Cited

U.S. PATENT DOCUMENTS 7,088,052 B2 * 8/2006 Kimura ..... 315/169.2
2002/0175662 A1 11/2002 Sakurai et al.
2004/0032382 A1 * 2/2004 Cok et al. ..... 345/82
2004/0124780 A1 * 7/2004 Ha et al. ..... 315/169.3
2005/0179627 A1 * 8/2005 Hayafuji et al. ..... 345/76
2005/0190128 A1 * 9/2005 Hayafuji ..... 345/76
2005/0258772 A1 * 11/2005 Park et al. ..... 315/169.1
2006/0164355 A1 7/2006 Kim et al.
2006/0267883 A1 * 11/2006 Hu ..... 345/76

(Continued)

FOREIGN PATENT DOCUMENTS

CN 1711584 A 12/2005
CN 1743932 A 3/2006

(Continued)

OTHER PUBLICATIONS

JPO Office Action dated Aug. 2, 2011 for JP Application No. 2009-004033 (3 pages).

(Continued)

*Primary Examiner* — Lun-Yi Lao
*Assistant Examiner* — Priyank Shah
(74) *Attorney, Agent, or Firm* — Christie, Parker & Hale, LLP

(57) ABSTRACT

An organic light emitting display device includes: a display unit for displaying an image corresponding to data signals, scan signals, a first power, and a second power; a gamma correction unit for generating a gray level voltage corresponding to each gray level in accordance with a reference voltage; a voltage generator for generating the reference voltage; a data driver for generating the data signals by utilizing an image signal and the gray level voltages, and for transmitting the data signals to the display unit; a scan driver for generating the scan signals and transmitting the scan signals to the display unit; and a power supply unit for generating the first power and second power and for transmitting the powers to the display unit, wherein the reference voltage is a first reference voltage corresponding to an input power from the outside or a second reference voltage corresponding to the first power.

12 Claims, 4 Drawing Sheets

(56) References Cited

U.S. PATENT DOCUMENTS

| | | | | |
|---|---|---|---|---|
| 2007/0063937 | A1* | 3/2007 | Kang et al. | 345/82 |
| 2007/0146253 | A1* | 6/2007 | Tang | 345/77 |
| 2008/0024526 | A1* | 1/2008 | Ko et al. | 345/690 |
| 2008/0266216 | A1* | 10/2008 | Choi | 345/77 |
| 2009/0160740 | A1* | 6/2009 | Leon et al. | 345/76 |
| 2009/0218937 | A1* | 9/2009 | Lee | 313/504 |
| 2011/0187693 | A1* | 8/2011 | Chung | 345/211 |

FOREIGN PATENT DOCUMENTS

| | | | |
|---|---|---|---|
| CN | 1811537 | A | 8/2006 |
| EP | 2 023 326 | A2 | 2/2009 |
| JP | 2002-351417 | | 12/2002 |
| JP | 2005-201916 | | 7/2005 |
| JP | 2005-340919 | | 12/2005 |
| JP | 2007-047791 | | 2/2007 |
| JP | 2007-233109 | | 9/2007 |
| JP | 2009-205124 | | 9/2009 |
| KR | 1020050078243 | A | 8/2005 |
| KR | 10-2005-0090514 | | 9/2005 |
| KR | 1020060018391 | A | 3/2006 |
| KR | 1020060078588 | A | 7/2006 |
| KR | 10-2006-0114453 | | 11/2006 |
| KR | 10-0667085 | | 1/2007 |

OTHER PUBLICATIONS

Chinese Office Action dated Nov. 9, 2011 issued in Chinese Application No. 2009-10159095.0 which claims priority of the corresponding Korean priority application No. 10-2008-0076941, 6 pages.

European Office action dated Mar. 22, 2012 for corresponding European Patent Application No. 09 167 335.0, 5pp.

Korean Office action dated May 6, 2010 for the corresponding Korean priority application No. 10-2008-0076491, 2 pags.

KIPO Office Action dated Dec. 18, 2009, for Priority Korean Application No. 10-2008-0076941.

SIPO Certificate of Patent dated Aug. 29, 2012, for corresponding Chinese Patent application 200910159095.0, (3 pages).

* cited by examiner

DRIVER IC AND ORGANIC LIGHT EMITTING DISPLAY DEVICE USING THE SAME

CROSS-REFERENCE TO RELATED APPLICATIONS

This application claims priority to and the benefit of Korean Patent Application No. 10-2008-0076941, filed on Aug. 6, 2008, in the Korean Intellectual Property Office, the entire content of which is incorporated herein by reference.

BACKGROUND OF THE INVENTION

1. Field of the Invention

The present invention relates to a driver IC and an organic light emitting display device using the same.

2. Description of Related Art

Recently, various flat panel display devices having reduced weight and volume compared to cathode ray tubes have been developed. Among the different types of flat panel display devices are liquid crystal display devices, field emission display devices, plasma display panels, and organic light emitting display devices, among others.

Among the flat panel display devices, the organic light emitting display device has various advantages, such as excellent color reproducibility and reduced thickness. Accordingly, the organic light emitting display device has expanded its market into a variety of applications, such as PDAs, MP3 players, and portable phones.

The organic light emitting display device displays an image using organic light emitting diodes (OLEDs) which generate light by recombining electrons and holes generated corresponding to a flow of current.

FIG. 1 is a circuit diagram showing a pixel of a general organic light emitting display device. Referring to FIG. 1, a pixel includes a first transistor M1, a second transistor M2, a capacitor Cst, and an organic light emitting diode (OLED).

A source electrode of the first transistor M1 is coupled to a first power supply ELVDD, a drain electrode thereof is coupled to an anode electrode of the OLED, and a gate electrode thereof is coupled to a first node N1.

A source electrode of the second transistor M2 is coupled to a data line Dm, a drain electrode thereof is coupled to the first node N1, and a gate electrode thereof is coupled to a scan line Sn.

A first electrode of the capacitor Cst is coupled to the first power supply ELVDD and a second electrode thereof is coupled to the first node N1.

An anode electrode of the OLED is coupled to the drain electrode of the first transistor M1 and a cathode electrode thereof is coupled to a second power supply ELVSS.

The pixel determines an amount of current flowing to the OLED in accordance with a voltage difference between the source electrode and the gate electrode of the first transistor M1. In other words, the amount of current flowing to the OLED is determined according to the voltage of the first power supply ELVDD and data signals from the data line Dm.

As a result, if a ripple occurs in the voltage of the first power supply ELVDD, a voltage difference between the source electrode and the gate electrode of the first transistor M1 is varied, and the current flowing to the OLED is fluctuated. Accordingly, flicker or noise is observed.

SUMMARY OF THE INVENTION

Accordingly, exemplary embodiments of the present invention provide a driver IC and an organic light emitting display device using the same for preventing or reducing occurrences of flicker or noise.

A first exemplary embodiment of the present invention provides an organic light emitting display device including: a display unit for displaying an image corresponding to data signals, scan signals, a first power, and a second power; a gamma correction unit for generating a gray level voltage corresponding to each gray level in accordance with a reference voltage; a voltage generator for generating the reference voltage; a data driver for generating the data signals by utilizing an image signal and the gray level voltages, and for transmitting the generated data signals to the display unit; a scan driver for generating the scan signals and for transmitting the generated scan signals to the display unit; and a power supply unit for generating the first power and the second power and for transmitting the generated first and second powers to the display unit, wherein the reference voltage is a first reference voltage corresponding to an input power from the outside or a second reference voltage corresponding to the first power.

Another exemplary embodiment of the present invention provides an organic light emitting display device including: a display unit for displaying an image corresponding to data signals, scan signals, a first power, and a second power; a data driver for generating the data signals and for transmitting the generated data signals to the display unit; a scan driver for generating the scan signals and for transmitting the generated scan signals to the display unit; and a power supply unit for generating the first power and the second power and for transmitting the generated first and second powers to the display unit, wherein the data driver is configured to determine a voltage of each of the data signals in accordance with the first power.

Yet another exemplary embodiment of the present invention provides a driver IC including: a gamma correction unit for generating a gray level voltage corresponding to each gray level by utilizing a reference voltage; a voltage generator for generating the reference voltage; a data driver for generating data signals by utilizing an image signal and the gray level voltage; and a power supply unit for generating a first power and a second power and for transmitting the generated first and second powers to the display unit, wherein the reference voltage is a first reference voltage corresponding to an input power from the outside or a second reference voltage corresponding to the first power.

According to exemplary embodiments of the present invention, the driver IC and the organic light emitting display device using the same may use the voltage of the first power as a reference voltage used to generate the voltage of data signals in the gamma correction unit. Thereby, the voltage of the data signals may be adjusted according to fluctuations in the voltage of the first power, making it possible to prevent or reduce flicker or noise.

BRIEF DESCRIPTION OF THE DRAWINGS

The accompanying drawings illustrate exemplary embodiments of the present invention, and, together with the following description, serve to explain the principles of the present invention.

DETAILED DESCRIPTION OF EXEMPLARY EMBODIMENTS

Figure 1:
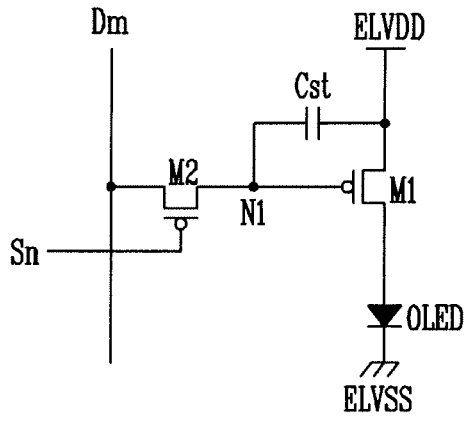
FIG. 1 is a circuit diagram showing a pixel of an organic light emitting display device according to an embodiment of the present invention.

Hereinafter, certain exemplary embodiments according to the present invention will be described with reference to the accompanying drawings. Here, when a first element is described as being coupled to a second element, the first element may be directly coupled to the second element, or may be indirectly coupled to the second element via one or more additional elements. Further, some elements that are not essential to a complete understanding of the invention are omitted for clarity. Also, like reference numerals refer to like elements throughout.

Figure 2:
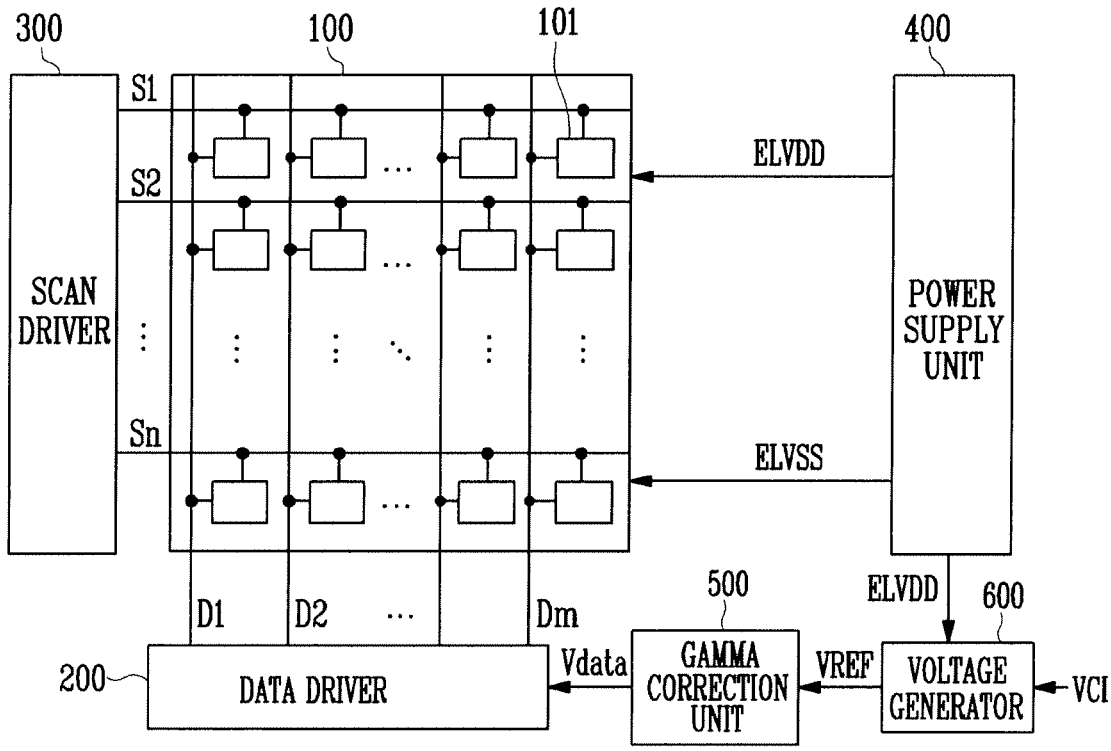
FIG. 2 is a schematic block diagram showing a structure of an organic light emitting display device according to an embodiment of the present invention.

FIG. 2 is a schematic block diagram showing a structure of an organic light emitting display device according to an exemplary embodiment of the present invention. Referring to FIG. 2, an organic light emitting display device includes a display unit 100, a data driver 200, a scan driver 300, a power supply unit 400, a gamma correction unit 500, and a voltage generator 600.

The display unit 100 includes a plurality of pixels 101, each pixel 101 including an organic light emitting diode (not shown) for emitting light corresponding to a flow of current. The display unit 100 includes n scan lines S1, S2, . . . , Sn−1, and Sn which transfer scan signals in a row direction and m data lines D1, D2, . . . Dm−1, and Dm which transfer data signals in a column direction. By way of example, pixels of the organic light emitting display device may have a structure similar to the structure as illustrated in and described with respect to FIG. 1, but may not be limited thereto.

Also, the display unit 100 is driven by receiving first power ELVDD and second power ELVSS having a voltage level lower than the first power ELVDD. Therefore, the display unit 100 is light-emitted by a flow of current to the OLED in accordance with the scan signal, the data signal, the first power ELVDD, and the second power ELVSS, to thereby display the image.

The data driver 200, generates data signals using image signals having red, blue, and green components. The data driver 200 is coupled to the data lines D1, D2, . . . Dm−1, and Dm of the display unit 100 to apply the generated data signals to the display unit 100.

The scan driver 300 generates scan signals, and is coupled to the scan lines S1, S2, . . . Sn−1, and Sn to transfer the scan signals to specific rows of the display unit 100. The pixel 101 to which a scan signal is transferred receives a voltage corresponding to the data signal output from the data driver 200 to transfer the voltage corresponding the data signal to the pixel 101.

The power supply unit 400 boosts the power input from the outside to generate the first power ELVDD and inverts the input power to generate the second power ELVSS.

The gamma correction unit 500 divides a reference voltage VREF to generate gray levels. Thereby, the gamma correction unit 500 generates a voltage Vdata of a data signal corresponding to each gray level.

The voltage generator 600 generates the reference voltage VREF using the first power ELVDD or a power VCI input from the outside. The generated reference voltage VREF is transferred to the gamma correction unit 500. The voltage generator 600 generates the reference voltage VREF using the input power VCI initially, and generates the reference voltage VREF using the first power ELVDD after a time (e.g., a predetermined time) has elapsed.

Figure 3:
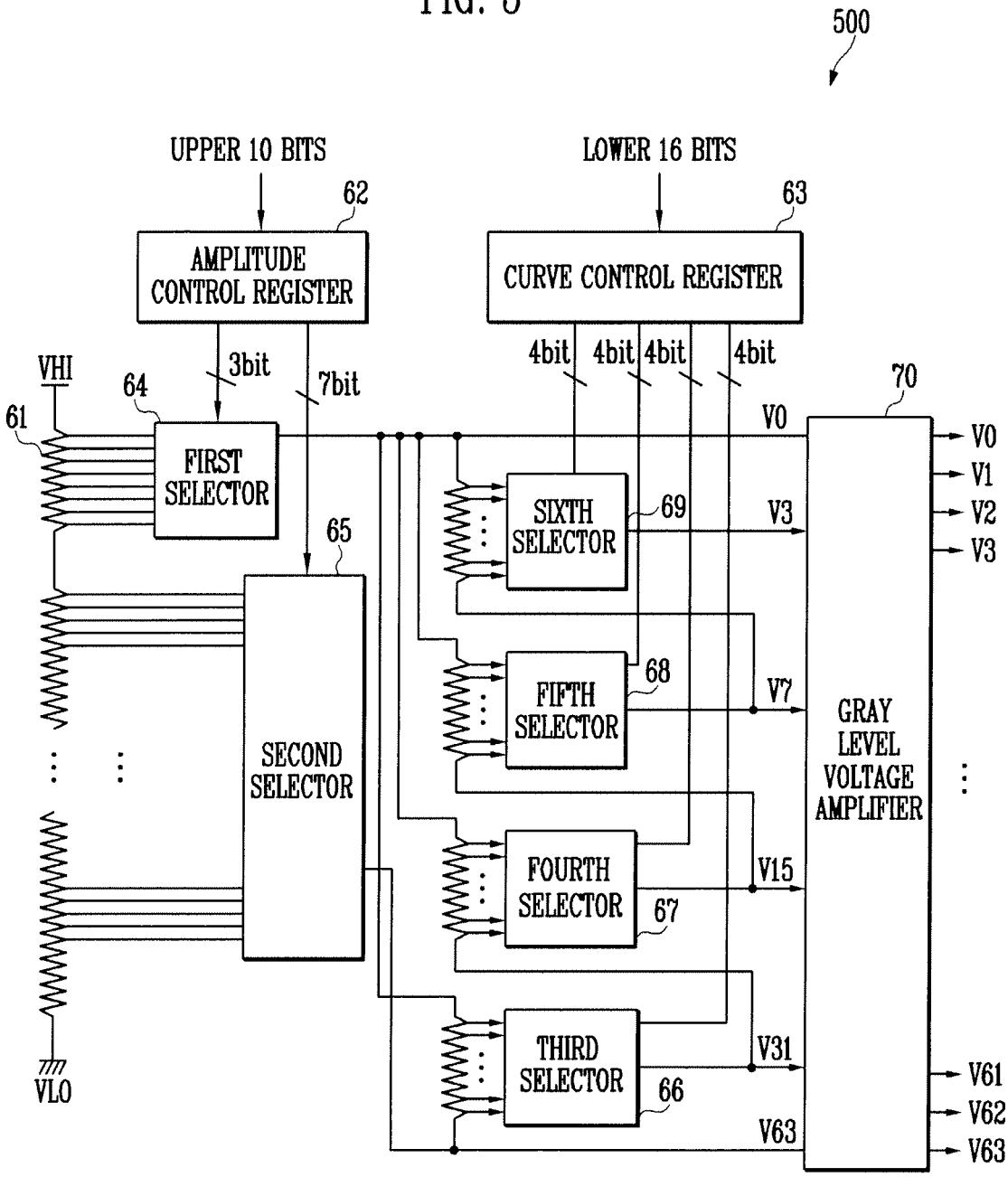
FIG. 3 is a schematic circuit diagram showing a gamma correction unit of the organic light emitting display device shown in FIG. 2.

FIG. 3 is a schematic circuit diagram showing the gamma correction unit of the organic light emitting display device shown in FIG. 2. Referring to FIG. 3, the gamma correction unit 500 includes a ladder resistor 61, an amplitude control register 62, a curve control register 63, first to sixth selectors 64 to 69, and a gray level voltage amplifier 70.

The ladder resistor 61 defines a reference voltage supplied from the voltage generator 600 as a highest level voltage VHI and includes a plurality of variable resistors between a lowest level voltage VLO and the highest level voltage VHI, the resistors being coupled serially. A plurality of gray level voltages (e.g., gamma voltages) are generated by utilizing the ladder resistor 61.

The amplitude control register 62 outputs a 3-bit register setting value to the first selector 64 and outputs a 7-bit register setting value to the second selector 65. At this time, the selectable number of gray levels may be increased as the number of bits is increased, and the register setting value may be changed so that the gray level voltages can be selected differently.

The curve control register 63 outputs a 4-bit register setting value to each of the third to sixth selectors 66 to 69. At this time, the register setting value may be changed and the selectable gray level voltage may be controlled according to the register setting value.

The amplitude control register 62 is input with the upper 10 bits of a register signal and the curve control register 63 is input with the lower 16 bits of the register signal.

The first selector 64 selects a gray level voltage corresponding to the a 3-bit register setting value from the amplitude control register 62 from among a plurality of gray levels, and outputs a selected gray level voltage as the highest gray level voltage.

The second selector 65 selects a gray level voltage corresponding to the 7-bit register setting value from the amplitude control register 62 from among the plurality of gray levels divided through the ladder resistor 61, and outputs a selected gray level voltage as the lowest gray level voltage.

The third selector 66 divides a voltage range between the level scale voltage output from the first selector 64 and the gray level voltage output from the second selector 65 into a plurality gray level voltages through a plurality of resistor rows, and selects a gray level voltage corresponding to the 4-bit register setting value and outputs the selected gray level voltage.

The fourth selector 67 divides a voltage range between the gray level voltage output from the first selector 64 and the gray level voltage output from the third selector 66 through a plurality of resistor rows and selects a gray level voltage corresponding to the 4-bit register setting value, and outputs the selected gray level voltage.

The fifth selector 68 selects a gray level voltage corresponding to the 4-bit register setting value from among the gray level voltages between the first selector 64 and the fourth selector 67, and outputs the selected gray level voltage.

The sixth selector 69 selects a gray level voltage corresponding to the 4-bit register setting value from among the gray level voltages between the first selector 64 and the fifth selector 68, and outputs the selected gray level voltage.

Curve control of intermediate gray levels may be performed according to the register setting value of the curve control register 63 by the above-mentioned operation, making it possible to control gamma characteristics for each light emitting device. The resistance value of each ladder resistor 61 may be set so that a potential difference between the respective gray levels is set to be larger as a smaller gray level is displayed in order to make the gamma curve project upwardly, or alternatively may be set so that a potential difference between the respective gray levels is smaller as a smaller gray level is displayed in order to make the gamma curve project downwardly.

The gray level amplifier 70 outputs the plurality of gray level voltages corresponding to each of the plurality of gray levels to be displayed on the display unit 100. FIG. 3 outputs gray level voltages corresponding to 64 gray levels.

Figure 4:
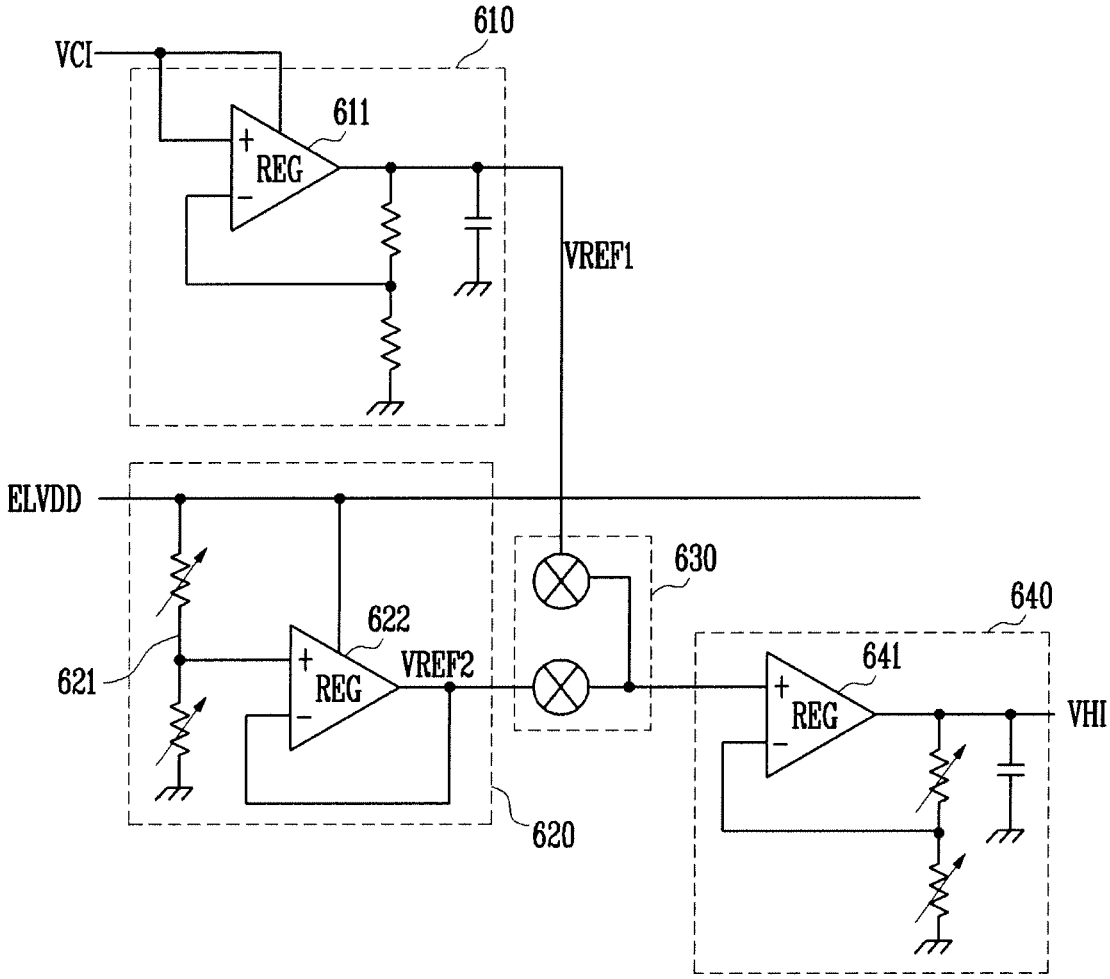
FIG. 4 is a circuit diagram showing a structure of a voltage generator utilized for generating voltage shown in FIG. 3.

FIG. 4 is a circuit diagram showing a structure of a voltage generator utilized for generating voltage shown in FIG. 2. Referring to FIG. 4, the voltage generator 600 includes a first reference voltage generator 610, a second reference voltage generator 620, a selector 630, and an output buffer 640.

The first reference voltage generator 610 receives an input voltage VCI from the outside to generate and output a first reference voltage VREF1 using a regulator 611.

The second reference voltage generator 620 receives a first power ELVDD from the power supply unit 400 and outputs a second reference voltage VREF2 using the regulator 622. Here, the first power ELVDD has a designated voltage level based on the resistor row 621.

If the gamma correction unit 500 uses the first reference voltage VREF1, ripples that occur in the first power ELVDD have no effect on the first reference voltage VREF1, since the first reference voltage VREF1 has a constant voltage. Therefore, if the voltage transferred to the gate electrode of the first transistor M1 of the pixel shown in FIG. 1 is constant, but the voltage of the first power ELVDD transferred to the source electrode of the first transistor M1 is fluctuated, such that the amount of current flowing to the OLED is different due to the fluctuation in the voltage difference between the source electrode and the gate electrode, noise or flicker may occur.

However, if a ripple which occurs in the voltage of the first power supply ELVDD is also transferred to the second reference voltage generator 620, the second reference voltage VREF2 is generated such that the ripple also occurs in the second reference voltage VREF2 corresponding to the ripple of the first power ELVDD. Therefore, both the voltage transferred to the source electrode and the voltage transferred to the gate electrode of the first transistor M1 of the pixel shown in FIG. 1 fluctuate concurrently, such that the voltage difference between the source electrode and the gate electrode may be maintained. Thereby, the amount of current flowing to the OLED is substantially maintained, and noise and/or flicker are reduced.

The output buffer 640 includes the regulator 641, which receives one of the first reference voltage VREF1 and the second reference voltage VREF2, and transfers it to the gamma correction unit 500.

Figure 5:
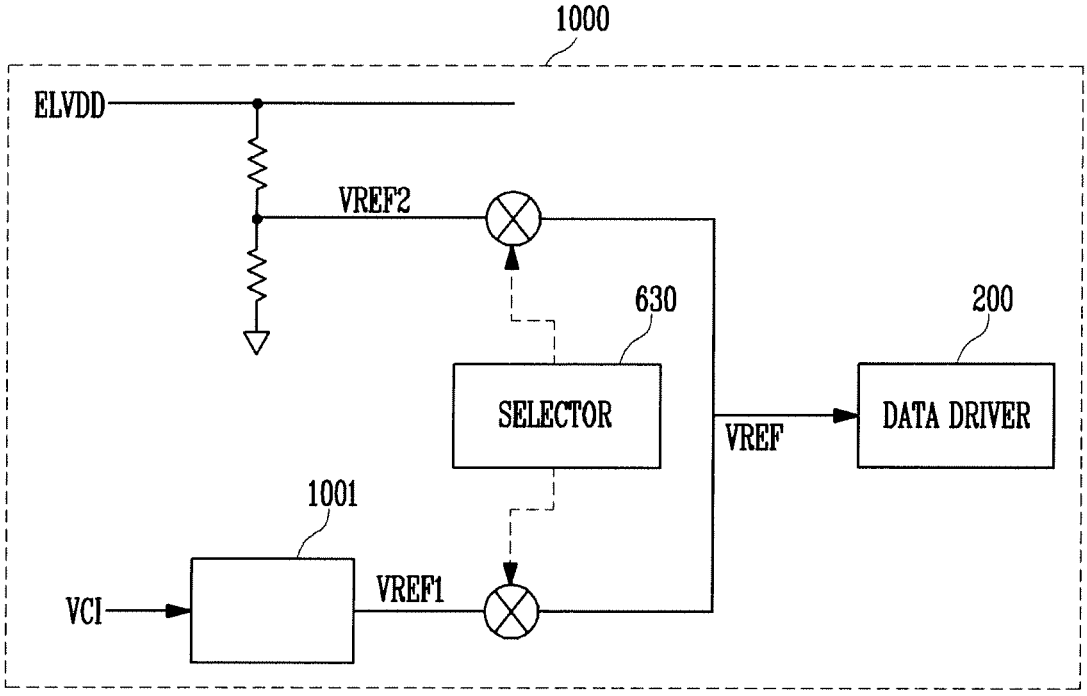
FIG. 5 is a conceptual view of the organic light emitting display device according to an embodiment of the present invention.

FIG. 5 is a conceptual view of a process of generating the gray scale voltage in the driver IC of the organic light emitting display device according to an exemplary embodiment of the present invention. Referring to FIG. 5, the driver IC generates the first reference voltage VREF1 using the external power supply VCI transferred from the outside and generates the second reference voltage VREF2 using the first power ELVDD generated from the power supply unit 400. The driver IC selects one of the first reference voltage VREF1 and the second reference voltage VREF2. In one embodiment, the selection of voltage is performed by the selector 630 using software. The data driver 200 generates a data signal by utilizing the selected voltage. The first reference voltage VREF1 may be formed by utilizing a circuit block 1001 and the second reference voltage VREF2 may be formed by voltage-dividing the first power ELVDD.

Since the power supply unit 400 is not in an enable state in the initial stage, the selector 630 initially enables the data driver 200 to generate a data signal using the first reference voltage VREF1. If the power supply unit 400 is in an enable state, since the first power ELVDD is being generated, the selector 630 enables the data driver 200 to generate a data signal using the second reference voltage VREF2 corresponding to the first power ELVDD.

If the data signal is generated in the data driver 200 using the second reference voltage VREF2, when a ripple occurs in the first voltage ELVDD, a ripple corresponding to the ripple of the first power ELVDD occurs in the voltage of the data signal. In other words, when the voltage of the first power ELVDD is high, the voltage of the data signal is correspondingly high, and when the voltage of the first power ELVDD is low, the voltage of the data signal is correspondingly low. As shown in FIG. 1, the data signal is transferred to the gate electrode of the first transistor M1 and the first power ELVDD is transferred to the source electrode thereof. In other words, when the voltage of the source electrode of the first transistor M1 is high, the voltage of the gate electrode is correspondingly high, and when the voltage of the source electrode of the first transistor M1 is low, the voltage of the gate electrode is correspondingly low. Therefore, the voltage difference between the source and gate electrodes of the first transistor M1 may be constantly maintained. For this reason, the current generated in the pixel may also be constantly maintained, making it possible to reduce the noise or flicker.

While the present invention has been described in connection with certain exemplary embodiments, it is to be understood that the invention is not limited to the disclosed embodiments, but is instead intended to cover various modifications and equivalent arrangements included within the spirit and scope of the appended claims, and equivalents thereof.

What is claimed is:

1. An organic light emitting display device comprising:

a display unit for displaying an image corresponding to data signals, scan signals, a first power, and a second power;

a gamma correction unit for generating gamma corrected gray level analog reference voltages corresponding to gray levels by utilizing a gamma correction reference voltage;

a gamma correction reference voltage generator for generating the gamma correction reference voltage switchably from the first power or from an input power supplied from outside the organic light emitting display device;

a data driver for generating the data signals by utilizing image signals and the gamma corrected gray level analog reference voltages, and for transmitting the generated data signals to the display unit;

a scan driver for generating the scan signals and for transmitting the generated scan signals to the display unit; and a power supply unit for generating the first power and the second power, for transmitting the generated first and second powers to the display unit, and for transmitting the generated first power to the gamma correction reference voltage generator, wherein the gamma correction reference voltage is switchably generated from a first reference voltage generated from the input power, or a second reference voltage generated from the first power, and wherein the gamma correction reference voltage generator comprises a first reference voltage generator for generating the first reference voltage from the input power.

2. The organic light emitting display device as claimed in claim 1, wherein the gamma correction reference voltage generator further comprises:

a second reference voltage generator for receiving and voltage dividing the first power into a divided voltage, and for generating the second reference voltage by utilizing the divided voltage; and a selector for selecting the first reference voltage or the second reference voltage.

3. The organic light emitting display device as claimed in claim 2, wherein the selector is configured to select the first reference voltage for an initial driving period, and to select the second reference voltage after the initial driving period.

4. The organic light emitting display device as claimed in claim 1, wherein the gamma correction unit comprises a gamma correction circuit for generating the gamma corrected gray level analog reference voltages by utilizing the gamma correction reference voltage.

5. The organic light emitting display device as claimed in claim 1, wherein the display unit comprises a plurality of pixels, each of the plurality of pixels comprising an organic light emitting diode for emitting light in accordance with the first power and the data signals.

6. The organic light emitting display device as claimed in claim 5, wherein the gamma correction reference voltage generator is configured to reflect fluctuations in the first power by generating corresponding said fluctuations in the second reference voltage.

7. The organic light emitting display device as claimed in claim 1, wherein the gray levels comprise 64 gray levels.

8. A driver IC for driving a display unit, the driver IC comprising:

a gamma correction unit for generating gamma corrected gray level analog reference voltages corresponding to gray levels by utilizing a gamma correction reference voltage;

a gamma correction reference voltage generator for generating the gamma correction reference voltage switchably from a first power or from an input power supplied from outside the driver IC and the display unit;

a data driver for generating data signals by utilizing image signals and the gamma corrected gray level analog reference voltages; and a power supply unit for generating the first power and a second power, for transmitting the generated first and second powers to the display unit, and for transmitting the generated first power to the gamma correction reference voltage generator, wherein the gamma correction reference voltage is switchably generated from a first reference voltage generated from input power, or a second reference voltage generated from the first power, and wherein the gamma correction reference voltage generator comprises a first reference voltage generator for generating the first reference voltage from the input power.

9. The driver IC as claimed in claim 8, wherein the gamma correction reference voltage generator further comprises:

a second reference voltage generator for receiving and voltage dividing the first power into a divided voltage, and for generating the second reference voltage by utilizing the divided voltage; and a selector for selecting the first reference voltage or the second reference voltage.

10. The driver IC as claimed in claim 9, wherein the selector is configured to select the first reference voltage for an initial driving period, and to select the second reference voltage after the initial driving period.

11. The driver IC as claimed in claim 8, wherein the gamma correction unit comprises a gamma correction circuit for generating the gamma corrected gray level analog reference voltages by utilizing the gamma correction reference voltage.

12. The driver IC as claimed in claim 8, wherein the gamma correction reference voltage generator is configured to reflect fluctuations in the first power by generating corresponding said fluctuations in the second reference voltage.

* * * * *